US005146726A

United States Patent [19]

Ellison, Jr.

[11] Patent Number: 5,146,726

[45] Date of Patent: Sep. 15, 1992

[54] COMPOSITE BUILDING SYSTEM AND METHOD OF MANUFACTURING SAME AND COMPONENTS THEREFOR

[76] Inventor: Russell P. Ellison, Jr., 109 Ralston Rd., Richmond, Va. 23229

[21] Appl. No.: 603,515

[22] Filed: Oct. 26, 1990

[51] Int. Cl.[5] ..... E04B 5/10

[52] U.S. Cl. ..... 52/320; 52/323; 52/324

[58] Field of Search ..... 52/320, 323, 324

[56] References Cited

U.S. PATENT DOCUMENTS 2,005,958 6/1935 Sereff ..... 52/323
2,110,110 3/1938 Murch ..... 52/324

FOREIGN PATENT DOCUMENTS 239501 4/1965 Austria ..... 52/322
872839 4/1953 Fed. Rep. of Germany ..... 52/324
1484063 12/1968 Fed. Rep. of Germany ..... 52/320
500232 11/1954 Italy ..... 52/320

*Primary Examiner*—David A. Scherbel
*Assistant Examiner*—Joanne C. Downs
*Attorney, Agent, or Firm*—Staas & Halsey.

[57] ABSTRACT

A composite building system includes a joist having a lower flange, a plurality of masonry blocks supported on opposite sides of the joist by the flange and defining a longitudinal trough in which the joist is disposed, the blocks having mutually co-planar upper surfaces and at least one stepped upper edge, the stepped upper edges of the plurality of blocks running substantially transverse the trough in a grid-like pattern, a network of wire lateral reinforcement disposed in at least some of the stepped edges; and a flowable grout filling the stepped edges and the trough and, when cured, binding the joist and the plurality of blocks to form an integral structure having a substantially planar upper surface.

18 Claims, 5 Drawing Sheets

COMPOSITE BUILDING SYSTEM AND METHOD OF MANUFACTURING SAME AND COMPONENTS THEREFOR

BACKGROUND OF THE INVENTION

1. Field of the Invention

The present invention relates generally to building structures and, more specifically, to a building system using masonry blocks, grout and open web steel joists.

2. Description of the Related Art

Concrete is the most widely used structural and civil engineering material today. Its applications range from small objects like fence posts to roads, dams, and other massive structures.

The key to concrete's wide structural use is in its inherent strength under compression. Although concrete by itself is very strong in compression, it has limited strength in tension and bending. Thus, it is common practice in forming slab structures, such as building floors, to reinforce the concrete. Most reinforcement is in the form of round-section mild steel. The bond between the concrete and the reinforcement is very important and as a result square twisted bars and ridged "deformed" bars are widely used to increase the bond. Another common technique for strengthening slabs of concrete is to prestress the concrete by placing tensioned steel bars, strands or cables in the slab prior to setting of the concrete so that when set, the prestressed concrete slab will be under constant compression.

Floor slabs and other structural components can be in the category of "precast" in that the concrete does not need to be cast on the construction site. There are some advantages associated with precasting concrete, including the reduction of on-site work in congested locations, and the control of standards of quality and the environment so as to avoid rain, freezing, etc.

A problem exists in certain building construction situations in that, for relatively short spans, it is difficult to obtain and use the heavy equipment which is necessary to lift and place the concrete slabs on their supports. While it is possible to avoid precast structures by casting the slab in place, another problem arises in that forms made of wood or other material must be built in place and the retrieval of the forming structures is very difficult. Moreover, the cost of forming concrete on the site is expensive, although the per unit cost can only be decreased if the form material and methods can be reused. Nonetheless, forming, pouring and finishing a concrete slab takes special skills and equipment, thus resulting in costs that can be prohibitive unless the building structure is very large so as to afford repetitive forming.

Thus, a need exists for an alternative to precast or cast on-site concrete floor slabs.

SUMMARY OF THE INVENTION

An object of the present invention is to provide a composite building system which is capable of being fabricated by non-specialized workers using existing non-costly building materials.

Another object of the present invention is to provide a composite building system which can be used to fabricate structural units, such as floor slabs, in place, thereby obviating special transportation and lifting needs for large, precast concrete products.

Another object of the present invention is to provide a composite building method which can be used on-site to construct structural units quickly and inexpensively.

Another object of the present invention is to provide a composite building system which does not require temporary shoring.

Yet another object of the present invention is to provide a composite building system which is capable of reducing the overall cost of fabricating and installing floor slabs, roof slabs, tilt-up wall sections, etc.

Still another object of the present invention is to create a composite building system which is capable of fabricating large building components with standard, inexpensive and readily available construction materials.

These and other objects of the invention are met by providing a composite building system which includes a joist having a lower flange, a plurality of masonry blocks supported on opposite sides of the joist by the flange and defining a longitudinal trough in which the joist is disposed, the blocks having mutually co-planar upper surfaces and at least one stepped upper edge running substantially transverse to the trough in a grid-like pattern, a network of wire lateral reinforcement disposed in the step edges of the plurality of masonry blocks, and a flowable grout filling the stepped edges and the trough, and when cured, binding the joist, the wires, and the plurality of blocks to form an integral structure having a substantially planar upper surface.

The aforementioned composite building system can be used to fabricate a plurality of building components, such as floor slabs. The blocks are preferably a standard size masonry concrete block (either nominally 16 inch or 24 inch long) and the joist is a special open-web-type joist capable of spanning from support to support. These joists are similar to standard steel bar joists and preferably can be made by the same manufacturing techniques. These special joists are preferably of minimum weight and are easy to handle such that for most spans, one individual could lift and position the joist during the assembly of the building component. Typically, the span is 16 feet or less for a 7-inch deep joist and nominally 8-inch block. This span length covers 95% of all residential construction. This type of joist is also called a "bar joist" because it typically is a welded truss assembled from steel bars and steel angles. In the present composite building system the special joist has two angles back to back at the bottom so as to provide a flange portion on opposite sides of the joist for supporting the blocks on opposite sides of the joist.

These and other features and advantages of the composite building system and method of the present invention will become more apparent with reference to the following detailed description and drawings.

BRIEF DESCRIPTION OF THE DRAWINGS

FIG. 7(*a*) is a partial cross-section showing a one-piece bottom chord.

DETAILED DESCRIPTION OF THE PREFERRED EMBODIMENTS

Figure 1:
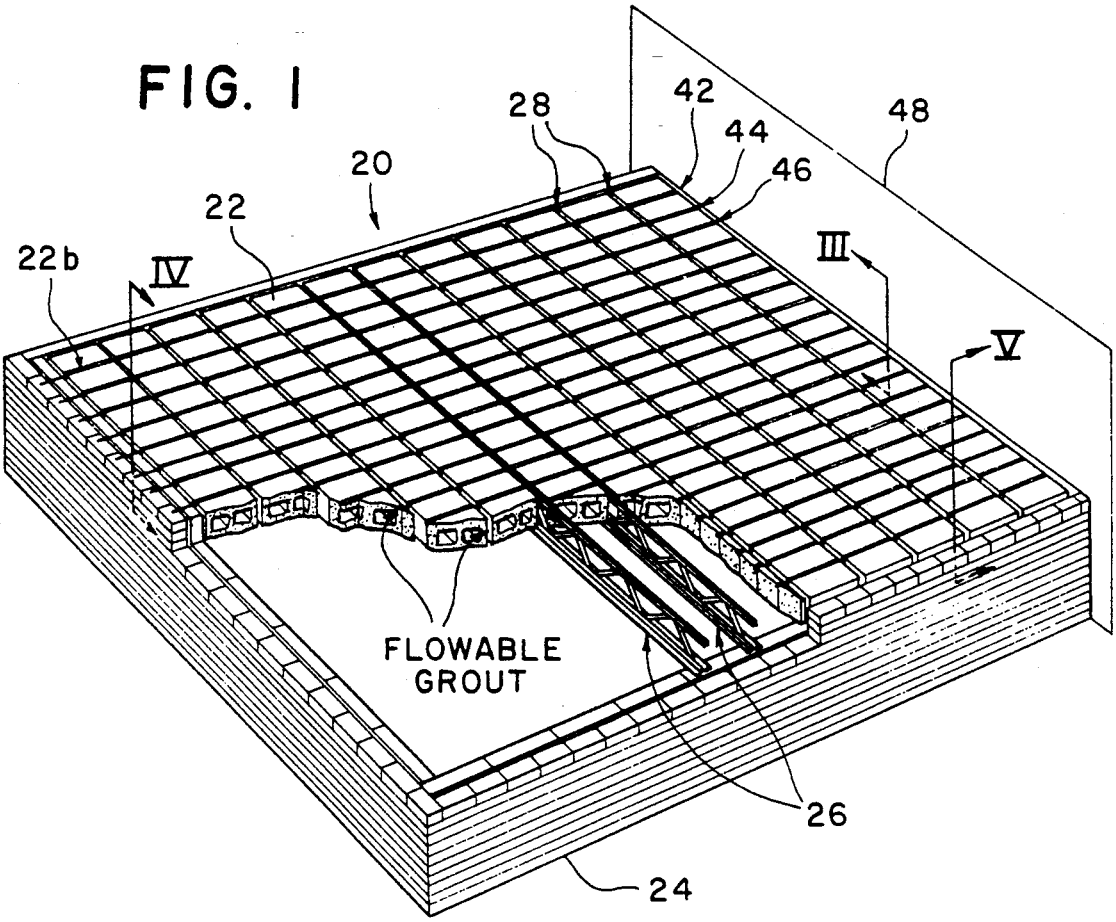
FIG. 1 is a perspective view, partially cut away, showing a composite building system according to the present invention used to create a floor slab which is illustrated on a foundation.
Figure 2:
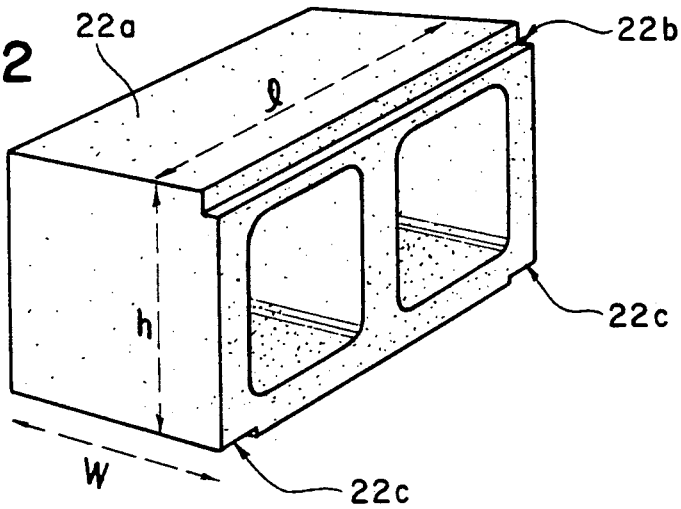
FIG. 2 is a perspective view of a masonry block used in the composite building system and floor slab illustrated in FIG. 1.

Referring now to FIG. 1, a composite building system according to the present invention is generally referred to by the numeral 20. The system 20 is a composite of inexpensive and easily accessible and workable materials including a plurality of masonry blocks 22 arranged side-by-side and end-to-end to form a floor slab which, in the embodiment illustrated in FIG. 1, is assembled on a foundation which provides support for the ends of joists 26 which are part of the component building system 20 and will be described in greater detail below. The blocks are ordinary concrete blocks which, when using a seven inch joist, are 8×8×16 inches. The block is commonly referred to as a "pier" block because it has a flat surface on both ends. It can be made of cement and hard rock aggregates or it can be made of cement and light weight aggregates. The 16 inch dimension is illustrated in FIG. 2 as the "l" (length) dimension, while the two 8 inch dimensions are referred to by the "h" and "w" for the height and width dimensions, respectively. Normally, this type of block is hollow and is laid down so that side 22*a* and its opposite counterpart are vertically disposed. In the present invention, the blocks are supported by the joists 26 with the surfaces 22*a* arranged horizontally so as to be coplanar, thereby collectively forming the upper surface of the floor slab. An 8×8×16 hollow block typically weighs between 22 and 32 pounds and can thus readily be handled by a single workman.

One aspect of the present invention is to provide a modified concrete block whereby at least one of the upper edges of the block is stepped as shown in FIG. 2 to form a groove referred to by the numeral 22*b*. Referring again to FIG. 1, when the blocks 22 are arranged end-to-end, a plurality of parallel troughs 28 are formed parallel to each other and each trough contains one of the joists 26. The stepped edge 22*b* of each block 22 formed in the side surface 22*a* are aligned so as to be transverse the troughs 28 thereby creating a grid-like pattern. A continuous groove is formed by aligning the stepped edges of all of the blocks in a given row.

The stepped edges 22*b* of all of the blocks 22 provide a plurality of transverse grooves which are preferably about ½ inch wide and about ¾ inch deep. The 8 inch block (8×8×16) is used in conjunction with a 7 inch (height) joist, which is a standard, relatively inexpensive building material. A 12 inch block (12×8×16) could be used if a deeper joist were required.

Figure 6:
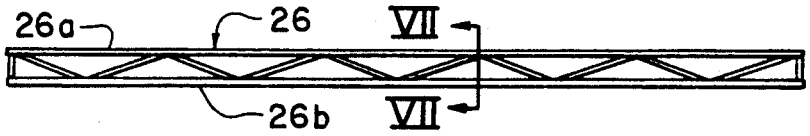
FIG. 6 is a side elevational view of a joist used in the composite building system of FIG. 1.
Figure 7:
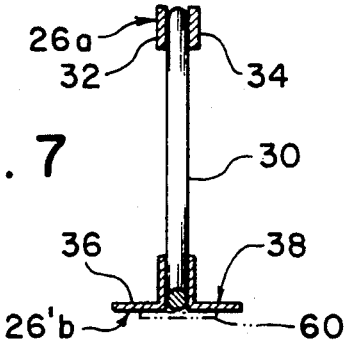
FIG. 7 is a sectional view of the joist of FIG. 6, taken along line VII.
Figure 7A:
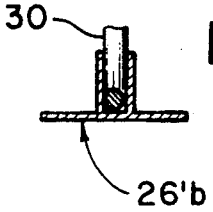

Referring to FIGS. 6 and 7, each joist 26 has an upper chord 26*a* and a lower chord 26*b*. This joist is commonly referred to as a "bar joist" and has a web member 30 with a number of spaced top points and bottom points which is welded to the upper chord 26*a* and the lower chord 26*b*, respectively. The upper chord 26*a* includes a pair of ¼ inch by 1 inch bars 32 and 34 which run the length of the joist. The lower chord 26*b* includes a pair of angle bars 36 and 38 which also run the length of the joist and are connected by welding to the web member 30 back-to-back so as to provide a flange which extends orthogonally outwardly from opposite sides of the web member 30. Each angle bar 36 and 38 is of standard dimensions, 1 and ¼ inch by 1 and ¼ inch by ⅛ inch. The steel used in fabricating the joist 26 has a yield strength of 50,000 psi in the web member and angles and 36,000 psi in the bars forming the upper chord. The flange provided at the bottom is essential for supporting the blocks at their ends, so that one joist 26 will support the ends of two blocks from opposite sides. Of course, the number of blocks supported on each side of the joist is dependent on the length of the joist.

Figure 3:
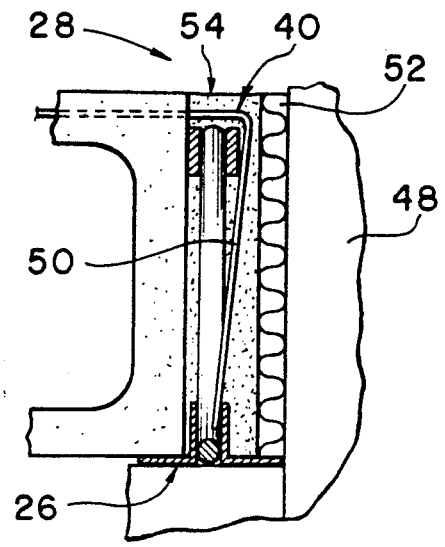
FIG. 3 is a sectional view taken along the line III of FIG. 1.
Figure 5:
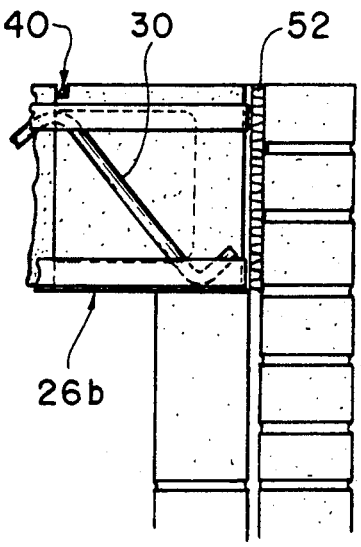
FIG. 5 is a sectional view taken along line V of FIG. 1.
Figure 4:
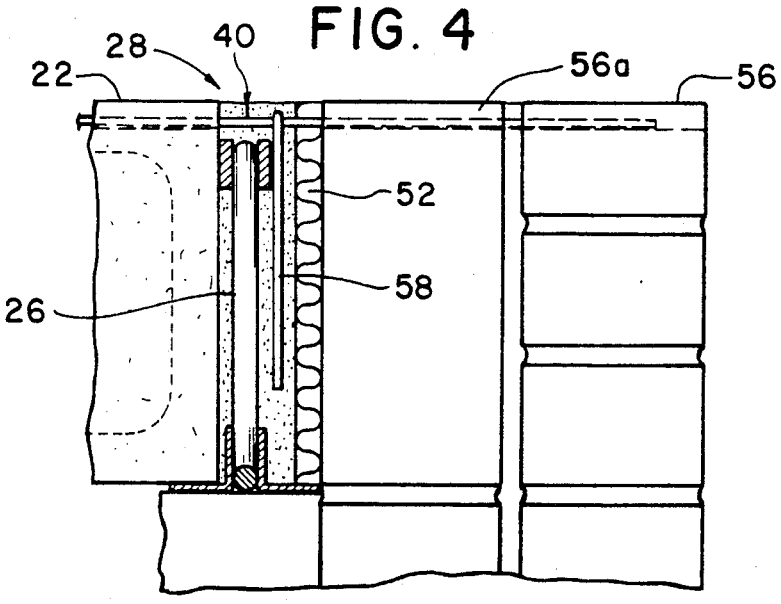
FIG. 4 is a sectional view taken along the line IV of FIG. 1.

Transverse grooves are provided so that, when the grooves are filled with grout, the blocks are in continuous and intimate contact with each other. The transverse grooves are also provided for embedding a network of wire reinforcement. As shown in FIGS. 3-5, the network of wire reinforcement includes a plurality of wires 40 which are placed in the grooves prior to the application of a grout. The wire is preferably 9 gauge wire cut in lengths to be disposed preferably in every groove. However, in an alternative embodiment, 8 gauge wire could be disposed in every other groove. In this instance, the word "groove" refers, in FIG. 1, to the groove which runs the entire width of the foundation, from end-to-end, and which is made of a plurality of individual stepped edges 22*b*. The collective groove is referred to in FIG. 1 as groove 42 and it runs from one side of the foundation to the other. If 9 gauge wire is used, each of the collective grooves, such as grooves 42 and 44 would contain at least one segment of 9 gauge wire (if the wire was not of sufficient length to run the entire length of the foundation, two segments of wire would be to be laid in with overlapping end portions). If 8 gauge wire is used, then, for example, groove 42 would be wired, but groove 44 would not be wired. The next groove, groove 46, would contain a wire, etc.

As shown in FIGS. 1 and 3, if an existing wall 48 is in abutment with the new floor slab made according to the composite building system 20, the ends 50 of the wires 40 are bent downwardly into the joist 26. A sheet of insulation 52 can be used between the existing wall 48 and the grout 54 which is subsequently poured into the trough 28 in which the joist 26 is disposed.

As shown in FIG. 4, at the opposite side of the foundation, the upper brick 56 and block 56*a* of the foundation is cut to form a groove in which the wire 40 can be extended. At the trough 28 adjacent the new side wall of the foundation, a hairpin wire 58 of 9 gauge wire may be extended into the trough 28 so that when grout is filled into the trough, the hairpin wires 58 help anchor the network of wire reinforcement. This would not necessarily be used in every trough.

The grout 54 is first filled in the troughs 28 prior to filling the grooves with grout. In order to keep the grout from running out at the bottom of the joist when the grout is in a plastic state, duct tape or other suitable means can be attached to the bottom of the lower chord 26*b* (see FIG. 7). The duct tape illustrated in FIG. 7 in phantom lines is referred to by the numeral 60 and can be placed over the bottom of the lower chord 26*b* prior to assembly of the components of the building system. The tape is intended to prevent grout from leaking out from the bottom chord 26*b*. Such tape 60 would not be necessary if the bottom chord 26'*b* was formed as a single piece as shown in FIG. 7(*a*). This would require the construction of a specialized joist and, while this could be done, joists according to FIG. 7 are currently commercially available.

Figure 8:
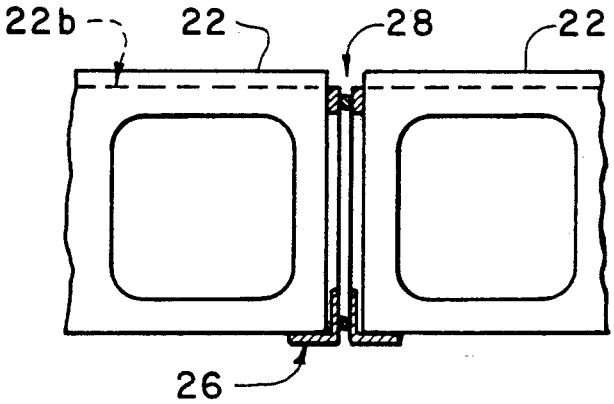
FIG. 8 is an enlarged sectional view showing two blocks supported by a joist according to the composite building system of FIG. 1.

FIG. 8 provides a better illustration of a typical trough 28 in which a joist 26 is disposed while supporting two adjacent blocks 22 at their opposing ends. Also shown in FIG. 8 are the transverse grooves formed by the stepped edges 22*b*. Once the blocks 22 are assembled in place, grout is filled in the troughs 28, but preferably, not in the grooves until after the grout in the troughs 28 has had a chance to settle for about 30 minutes.

After the troughs 28 have been filled, then grout is filled in the grooves formed by the stepped edges 22*b* so that the upper surface of the floor slab is substantially planar and smooth. The grout is a mixture of fine sand and Portland cement which may include admixes to provide a liquid consistency without an excessive amount of water for pouring into the troughs 28 and the grooves. Admixes such as super-plasticizers, air entraining agents, retarders, water reducers, etc., are well known and commercially available from a number of sources and would be used when and if desired. Preferably, the grout is made flowable so that it is unnecessary to use vibration or other means to fill all the voids in the area of the trough. The blocks should usually be dry when the troughs 28 are filled with flowable grout containing no admixes. The blocks quickly absorb the excess mixing water. The top surface of the block should be moistened prior to the filling of the grooves 42, 44 and 46 so that the grout in the grooves will not dry out too quickly.

Also, to be noted from FIG. 8, the blocks are taller than the joist, the upper chord is narrower in width than the lower chord, the web is narrower in width or thickness than the upper chord, the bottom edge of the block rest on the flange, and the blocks have straight vertical sides that abut the upper chord.

Figure 9:
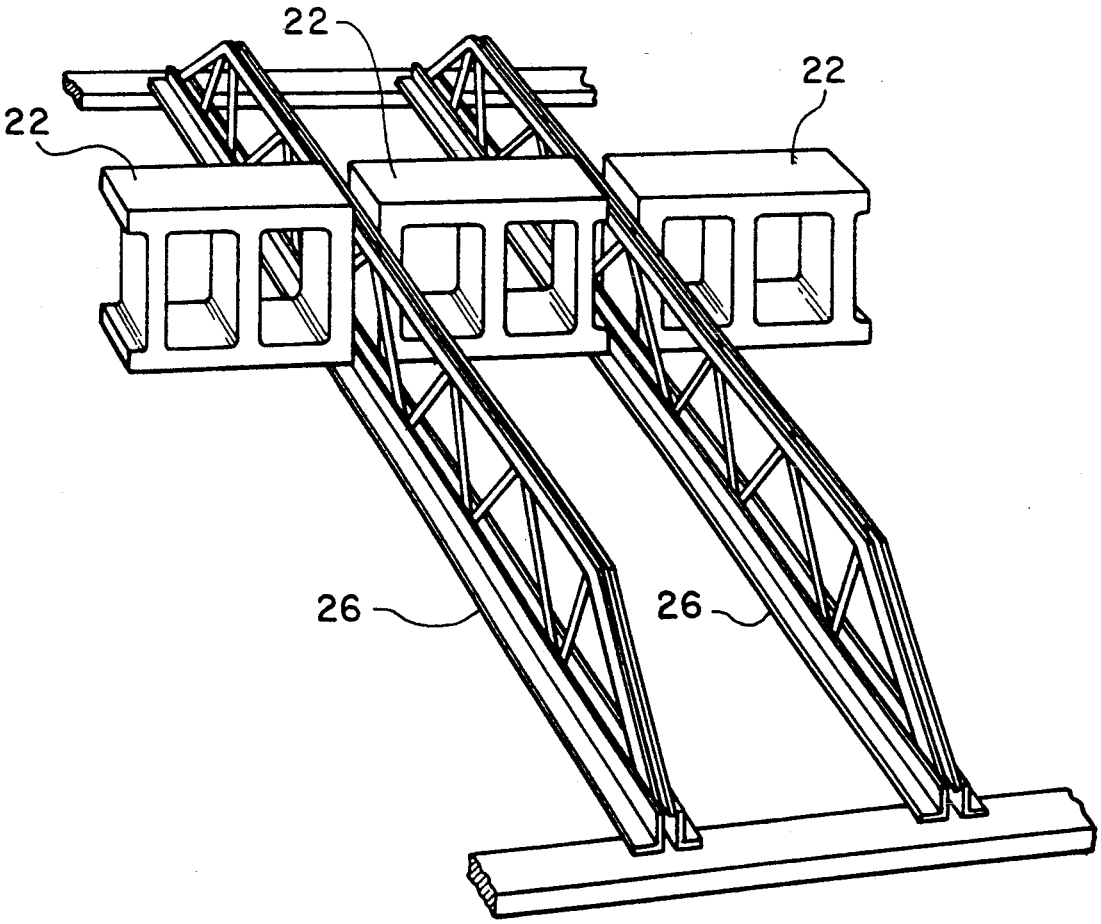
FIG. 9 is a perspective view of a partially assembled composite building system according to FIG. 1.

As seen in FIG. 9, the sides of the blocks 22 adjacent the joists may either be flat or have a recessed portion.

Figure 10:
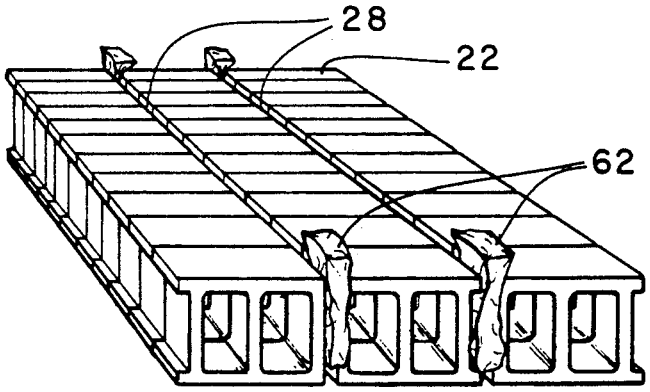
FIG. 10 is a perspective view of the composite building system in an intermediate condition of assembly.
Figure 11:
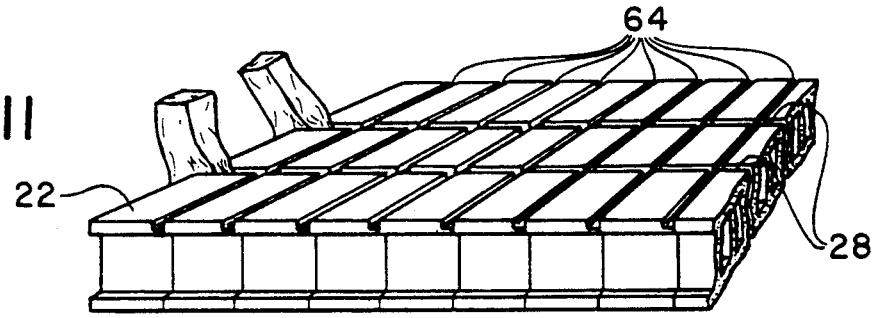
FIG. 11 is a perspective view of a composite building system of FIG. 1, partially cutaway, in a subsequent, intermediate condition of assembly.

Referring to FIGS. 9–12, a composite building system is shown in various stages of assembly. The joists are omitted from FIGS. 10–12. In FIG. 9, two joists 26 are placed side-by-side and parallel to each other, and a plurality of blocks 22 are placed on the flanges of the joists 26. The beginnings of two troughs 28 can be seen as to be formed between the juxtaposed ends of the blocks. Fully developed troughs are seen in FIG. 10. After all of the required blocks have been placed in their respective positions.

In order to fill the troughs with grout, grout obstructions 62 are placed in the opposite longitudinal ends of the troughs so that grout cannot flow out the ends. The obstructions 62 can be of any suitable means. The illustrated examples shows foam rubber or sponge-like material which can be easily deformed and fitted into irregular spaces.

After the obstructions 62 have been placed in the opposite ends, grout is poured into the troughs and is filled to approximately ¾ inch from the top. At this point, if the blocks 22 are of the type illustrated in FIG. 2, having a preformed stepped edge 22*b*, the method of assembly can proceed to the next step. However, if standard blocks are used as illustrated in FIGS. 9 and 10 (with no stepped edges) the transverse grooves must be formed by cutting with a masonry cutting saw so as to form the grooves shown in FIG. 11. These cut grooves, referred to by the numeral 64 can be formed on-site relatively easily with a standard cutting tool which consists of a circular saw blade.

Figure 12:
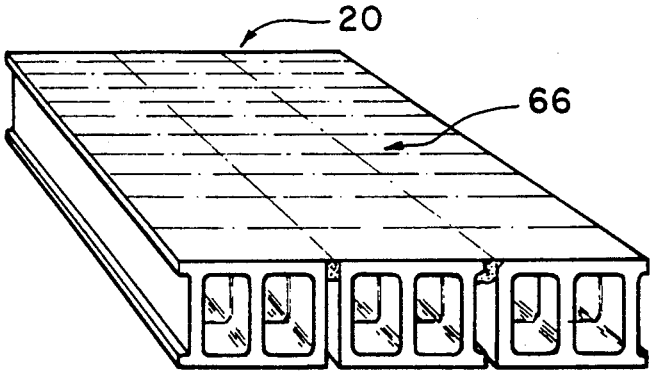
FIG. 12 is a perspective view of a finished composite building component using the composite building system of FIG. 1.

FIG. 12 is a view of the composite building system 20 made according to the present invention and consisting of a floor slab which can be lifted into place by a relatively small lift machine, or alternatively, the same structure could have been fabricated in-place, thus requiring no mechanical lifting means. If assembled outside its intended place of use, the floor slab shown in FIG. 12 can easily be lifted by a fork lift and moved to the desired position. The floor slab shown in FIG. 12 has an upper surface 66 which provides a floor for a building structure. The opposite side (not visible in FIG. 12) would provide the ceiling when the structure is used as a floor or roof slab.

The resulting structure illustrated in FIG. 12 is one which has physical similarities to a reinforced concrete slab of comparable thickness. Hollow blocks are used, and preferred, because they are cheaper and lighter, but solid blocks may be desirable under certain loading conditions or for sound attenuation.

As mentioned previously, the present invention is not limited to one size block and joist. For example, a larger span, in the range of 24 feet, could be accomplished with an 11 inch deep floor joist and a 12×8×16 block. 12×8×16 blocks spanning twelve inches instead of 16 inches would permit spans in the 32 foot range with 15 inch floor joist. Conversely, for shorter spans and lighter loads, the floor joists can be smaller and lighter. In any case, the top of the joist should be slightly below the height of the block so that it is always buried in the trough by grout and the transverse wires can be suitably embedded in grout.

It should also be noted that the system provides a smooth top surface suitable as a sub-floor, but the same system could be used to make a roof deck or other building structures. If a smoother surface is desired, or a load distributing under-layment is desired, a skim coat, concrete topping, gypsum topping, or a plywood-type under-layment may be added. The resultant structures are extremely fire-resistant since the concrete will act as a heat sink and thereby keep the temperature of the joist from rising too rapidly in a fire.

The block illustrated in FIG. 2 can also be provided at the bottom edges with grooves 22*c* at the opposite ends so that the flanges of the joists are flush with the bottom of the block. This provides a smoother ceiling.

From beginning to end, the method of constructing the system goes as follows:

First, the open web steel joists are produced or cut to a desired length and two-inch wide duct tape is applied to the bottom of each joist so as to prevent grout loss. Next, weld burrs are chipped off or ground off with a grinding tool since these may act as obstructions which prevent the blocks from pressing uniformly against the ¼ inch by 1 inch top chord bars. Where the top chord bars are closer than one-half inch apart, they must be pried apart to maintain the designed one-half inch gap or opening between them. This gap or opening is necessary for applying the grout into the troughs.

While steel normally used for standard bar joists is the normal material for making the special joists of this invention, they may be made of other materials. An example would be stainless steel for use over swimming pools.

Next, the joists are placed on their respective supporting structures, such as the foundation illustrated in FIG. 1, with the bottom chord of the two-inch joist being hard against the non-load bearing walls. Then, cap blocks are placed one at each end of the joists, solid side out. This will space and brace the joists. If desirable, perimeter insulation board can then be placed against the inside face of the bricks or other masonry at the ends of the joists and against the non-load bearing walls.

Next, the remaining blocks are placed in their respective positions, beginning at one end of the joists (at one bearing wall) and proceeding to the other end, laying a row at a time. In other words, all of the blocks between two joists should not be laid before laying the blocks between the other joists. Thus, it is important that one course be laid at a time from one bearing wall to the other, bumping the blocks tight against each other and maintaining the transverse grout groove in a straight line between all blocks. The grout grooves are then cut in the top of the block and brick non-bearing wall in line with the grooves in the blocks. Next, 10 foot segments of 9 gauge wire are laid in the grout grooves, overlapping them in the middle after bending the ends at the existing wall. The 9 gauge hairpin wires are then dropped over the transverse wires adjacent the non-load bearing wall. A flowable grout based on 2½:1 sand-/Portland-cement mixture is poured into the space between the blocks and the floor joists completely and without vibration. The flowable grout is poured into the longitudinal joints or troughs so that the joists are completely encased in grout. After a suitable delay of about 30 minutes, and after wetting the top surface of the block, the transverse grout grooves are then filled, making certain that the 9 gauge wires are fully embedded in the grout. After this, the upper surface is screeded, floated or trowelled to be as smooth as desired and the structure is covered with a polyethylene sheet for curing.

The finished product has been found to be remarkably strong and at least comparable to reinforced concrete slabs of comparable thickness.

Figure 13:
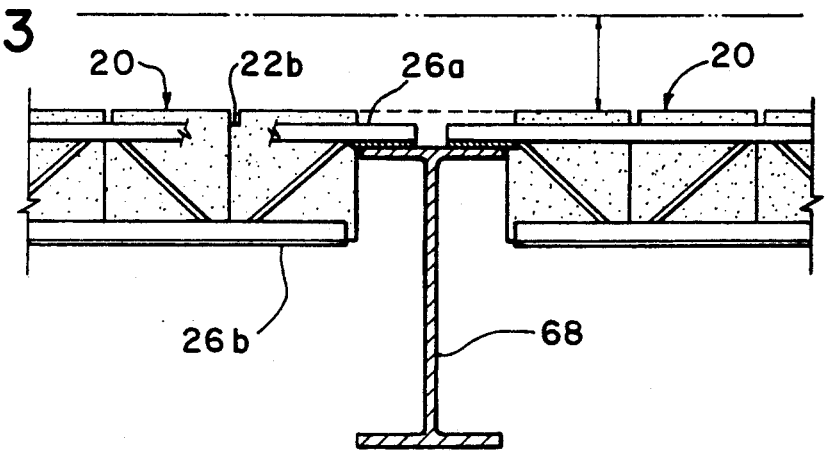
FIG. 13 is a view similar to FIG. 5 showing a top chord bearing.

In the system illustrated in FIG. 1, the fabricated floor slab is bottom-chord-bearing, in that the bottom chord **26*b* bears on the upper surface of a supporting structure. FIG. 13, however, illustrates an arrangement whereby the system is top-chord-bearing, whereby the top chords 26*a* are bearing on a steel I-beam 68. When bearing is under the top chord instead of the bottom chord, a shallower framing system can result. The difference in overall height is illustrated in FIG. 13 by a broken line drawn parallel to the upper surface of the slabs (indicated by the reference numerals 20**, which refer to the composite building system). The top chord bearing joists should be fabricated to length (as opposed to being cut on-site), but this should be acceptable to the fabricator because of the large quantity that would be required for a multi-story structure. The saving in height from top chord bearing becomes relatively greater as the depth of the floor/roof system increases from eight inches to twelve inches and the corresponding spans increase from 16 feet to 25 feet.

Figure 14:
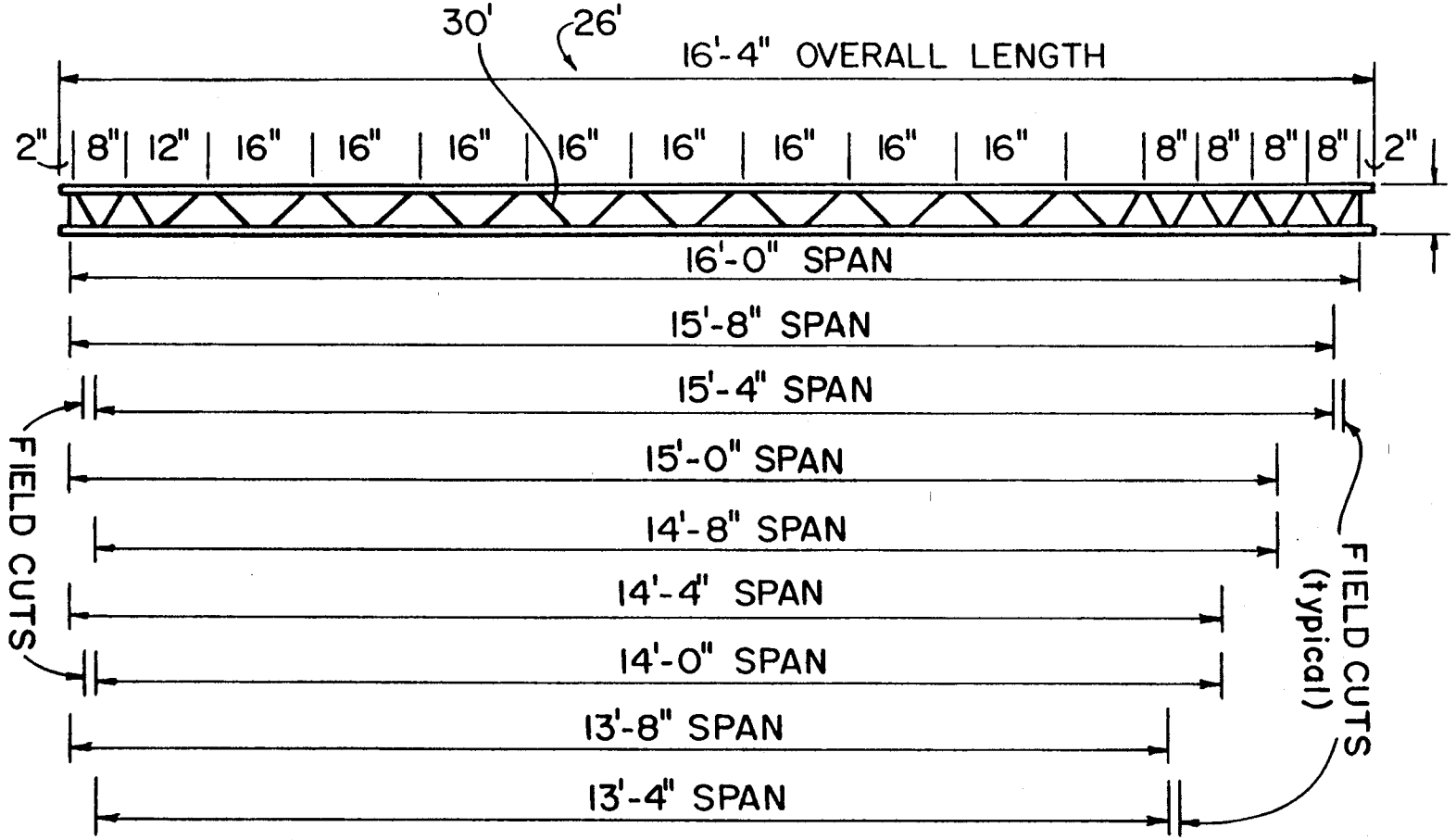
FIG. 14 is a side elevational view of a joist and various field cuts for various lengths.

FIG. 14 illustrates a joist 26' of the present invention which may be fabricated to provide greater latitude in making field cuts of the joist to suit specific length requirements. Normally, the web member 30' undulates at 16 inch intervals and the spans must be cut to lengths where the undulations touch the upper and/or lower chords. Normally, the undulations occur regularly at the aforementioned 16 inch intervals. According to the present invention, however, the joist has an undulating web member 30' which, at the opposite end portions, undulates at 8 inch intervals, and at a twelve-inch interval, so that a variety of spans can be cut in the field. This is made possible by the fact that the web member 30' contacts the upper and lower chords at closer intervals, and at intervals of different lengths so that, depending on the size of the cut required, a combination of cuts at opposite ends can result in a desired span length.

Numerous modifications and adaptations of the present invention will be apparent to those so skilled in the art. For example, the invention can be used to make a wall by first making a composite structure in the horizontal position, and after curing, tilting it upward for the wall. Thus, it is intended by the following claims to cover all such modifications and adaptations which fall within the true spirit and scope of the invention.

What is claimed is:

1. A composite building system comprising:

a metal open web joist having a lower chord with a lower flange, an upper chord with openings therein which is narrower than said lower chord and a web member narrower than said upper chord connected to and undulating between said lower and upper chords;

at least two columns of a plurality of masonry blocks taller than said joist with each column having at least some straight vertical sides and bottom edges with said bottom edges supported by and in contact with said flange of said joist so that one of said columns is on one side of said joist abutting and in contact with said upper chord and the other of said columns is on the opposite side of said joist abutting and in contact with said upper chord so as to define a longitudinal trough in which said joist is disposed to receive flowable grout poured through said openings in said upper chord to flow around said web member, the blocks having mutually co-planar upper surfaces and at least one stepped upper edge, the stepped upper edges of the plurality of blocks running substantially transverse the trough in a grid-like pattern; and a cured flowable grout filling the stepped edges and the trough and binding the joist and the plurality of blocks to form an integral structure having a substantially planar upper surface.

2. A composite building system according to claim 1, which further includes:

a network of a wire lateral reinforcement disposed in at least some of the stepped edges.

3. A composite building system according to claim 2, wherein the network of wire lateral reinforcement includes a wire segment disposed in the stepped upper edges of the plurality of blocks and a plurality of hairpin wires extending downwardly into the troughs from at least some of the wire segments.

4. A composite building system according to claim 1, wherein said web member has a series of spaced top points and said upper chord consists of two rectangular bars extending alongside of and welded to opposite sides of the top points of said undulating web member and said openings are the spaces between said bars and the spaces between said top points.

5. A composite building system according to claim 1, wherein the lower chord includes a pair of angles disposed back-to-back to form the flange in two portions, each portion extending in an opposite direction of each other and orthogonal to the web member.

6. A composite building system according to claim 1 wherein said straight vertical sides of said masonry blocks are flat.

7. A composite building system according to claim 1 wherein said sides of said masonry blocks include a recessed portion.

8. A method of making a composite building structure comprising the steps of:

positioning at least two metal open web joists parallel to each other with each of said joists having a lower chord with a lower flange, an upper chord with openings therein which is narrower than said lower chord, and a web member narrower than said upper chord connected to and undulating between said lower and upper chords;

arranging a plurality of masonry blocks which are taller than said joists with at least some straight vertical sides and bottom edges in rows and columns with the straight vertical sides of the blocks abutting and in contact with the upper chord of the joist which has been placed between each column and supporting the bottom edges of the blocks by being in contact with the lower flanges so that a trough is formed between each column;

providing a plurality of grooves transversely of the troughs in an upper surface of the plurality of blocks;

filling the troughs and grooves with flowable grout by pouring flowable grout through the openings in said upper chord to flow around said web member to fill said troughs; and curing the grout to form integral structures having a substantially planar upper surface.

9. A method according to claim 8, wherein there is provided an additional step for placing a network of lateral wire reinforcements in at least some of the grooves prior to filling the troughs and grooves with grout.

10. A method according to claim 9, wherein the step of placing wire reinforcement in the grooves includes anchoring the wire at an intersection with selected troughs with a hairpin wire extending downwardly into the trough from the wire reinforcement.

11. A method according to claim 8, wherein the step of producing the transverse grooves comprises preforming a step along an upper edge of the plurality of blocks and aligning the steps of the blocks in each row so as to form a plurality of transverse grooves.

12. A method according to claim 8, wherein the step of providing the plurality of transverse grooves comprises cutting the grooves along an upper edge of the plurality of blocks with a cutting tool after the blocks have been positioned on the joists.

13. A method according to claim 8, wherein the step of filling the troughs and grooves with grout comprises, at first, filling the troughs with grout, allowing the grout in the troughs to settle for about 30 minutes, filling the grooves with grout and then trowelling an upper surface of the building structure composed collectively of the upper surfaces of the plurality of building blocks.

14. A floor slab comprising:

a plurality of metal open web joists arranged parallel to each other, each having a lower chord with a lower flange, an upper chord with openings therein which is narrower than said lower chord and a web member narrower than said upper chord connected to and undulating between said lower and upper chords;

a plurality of masonry blocks trailer than said joists which have at least some straight vertical sides and bottom edges supported on opposite sides of the plurality of joists by said bottom edges resting on and in contact with said flanges in a plurality of rows and columns with said vertical sides abutting and in contact with said upper chords and defining a plurality of longitudinal troughs in which the joists are disposed, the blocks having mutually-coplanar upper surfaces and at least one stepped upper edge, the stepped upper edges being aligned to form a plurality of transverse grooves; and a cured flowable grout filling the grooves and the troughs and binding the joists and the plurality of blocks to form an integral structure having a substantially planar upper surface.

15. A floor slab according to claim 14, wherein there is further included:

a network of wire lateral reinforcements disposed in the plurality of grooves.

16. A floor slab according to claim 14, wherein said web member has a series of spaced top points and said upper chord consists of two rectangular bars extending alongside of and welded to opposite sides of the top points of said undulating web member and said openings are the spaces between said bars and the spaces between said top points.

17. A floor slab according to claim 16, wherein the slab is upper chord bearing.

18. A floor slab according to claim 16, wherein the slab is lower chord bearing.

* * * * *